US005248088A

United States Patent [19]

Prill et al.

[11] Patent Number: 5,248,088

[45] Date of Patent: Sep. 28, 1993

[54] ALTERNATING LIQUID/GAS ANTIFREEZE NOZZLE

[76] Inventors: James G. Prill, 415 Locust La.; Sharron Prill, 238 E. Maple, both of Roselle, Ill. 60172

[21] Appl. No.: 381,022

[22] Filed: Jul. 17, 1989

[51] Int. Cl.[5] ..... B05B 15/02

[52] U.S. Cl. ..... 239/112; 138/32; 239/553.3

[58] Field of Search ..... 239/112, 14.2, 553, 239/553.3, 553.5; 138/32; 137/59

[56] References Cited

U.S. PATENT DOCUMENTS 3,979,061 9/1976 Kircher ..... 239/14.2

4,789,190 12/1988 Eike et al. ..... 239/112

*Primary Examiner*—Andres Kashnikow

[57] ABSTRACT

An alternating liquid/gas antifreeze nozzle which embodies a tapered-crimped, sealed, closed-end, orificed, deflecting-tubular-chamber, mounted parallel to the direction of flow and upstream of the apertures which evacuates liquids in sub-freezing temperatures at different rates and thus allows both apertures to remain unblocked by freezing particles and thus available for subsequent re-use. To accomplish the above, a pressurized gas must be used.

1 Claim, 2 Drawing Sheets

ALTERNATING LIQUID/GAS ANTIFREEZE NOZZLE

BACKGROUND OF THE INVENTION

1) Field of the Invention

The present invention relates to a nozzle device which prevents liquid freeze-ups. More specifically, the present invention is a nozzle with an apertured-upstream-of-exit, singularly-mounted, closed tube; which allows complete evacuation of liquids through dual outlets of said nozzle.

2) Prior Art

Instances of incomplete evacuation of liquid from an enclosed area ending in a nozzle, during sub-freezing temperatures causes freezing particles to impede the aperture and thereby inactivate the apparatus for its subsequent re-use.

Currently, the method used to prevent liquid from freezing in nozzles is to allow liquid to constantly stream through the outlet so as the constantly moving liquid does not freeze. No other alternative to this method has been invented because of the availability of various inexpensive liquids; however, this will not remain so forever, so comes the need for the device invented.

A search of the patent field, class 239, subclass 504, disclosed patents such as U.S. Pat. Nos. 4,343,434 and 3,693,882 and 3,693,886; but these do not address the same issue. Each is not designed to specifically evacuate liquid from the enclosure.

No prior art for this invention could be found. No device is known to alleviate or eliminate freezing without the introduction of chemical or electrical; injection or device, respectively.

SUMMARY OF THE INVENTION

The principal object of the invention is to provide a device to prevent aperture freeze-up in nozzles. It is also the object of the present invention to provide such a device that will work with the use of pressurized gas.

The nozzle is used wherever the spraying of liquid is desired in a sub-freezing atmosphere.

The foregoing object can be accomplished by use of the device as follows:

after the spraying of liquid through the nozzle device, compressed gas forces out the last of the liquid to flow through either of two apertures in the invention. Liquid exists each at a different rate of speed so that the liquid from the direct aperture exits last, and usually freezes up; but the indirect aperture, having emptied prior, remains free of ice.

The nozzle can be used in freezing spraying applications and yet remain ice-clog free. It is especially useful in car wash systems in the Northern sector which are subject to freezes; however, it is certainly not limited to that application.

DETAILED DESCRIPTION

Figure 1:
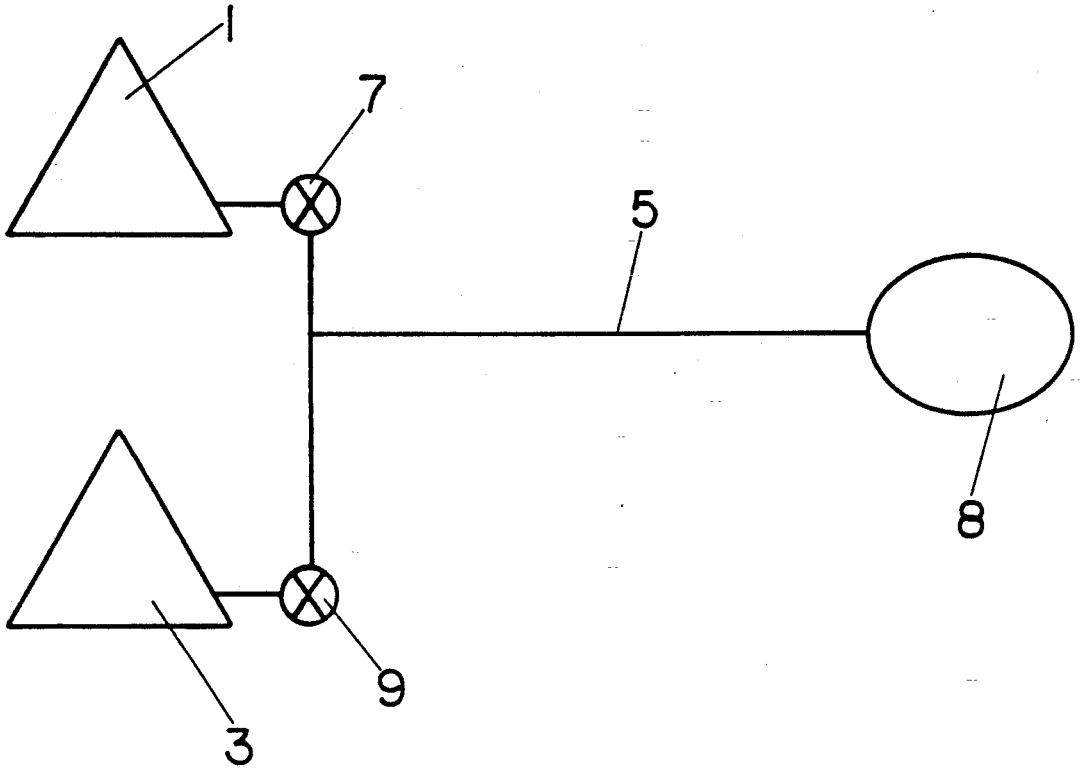
FIG. 1 is a schematic representation of the major components of the system.
Figure 2:
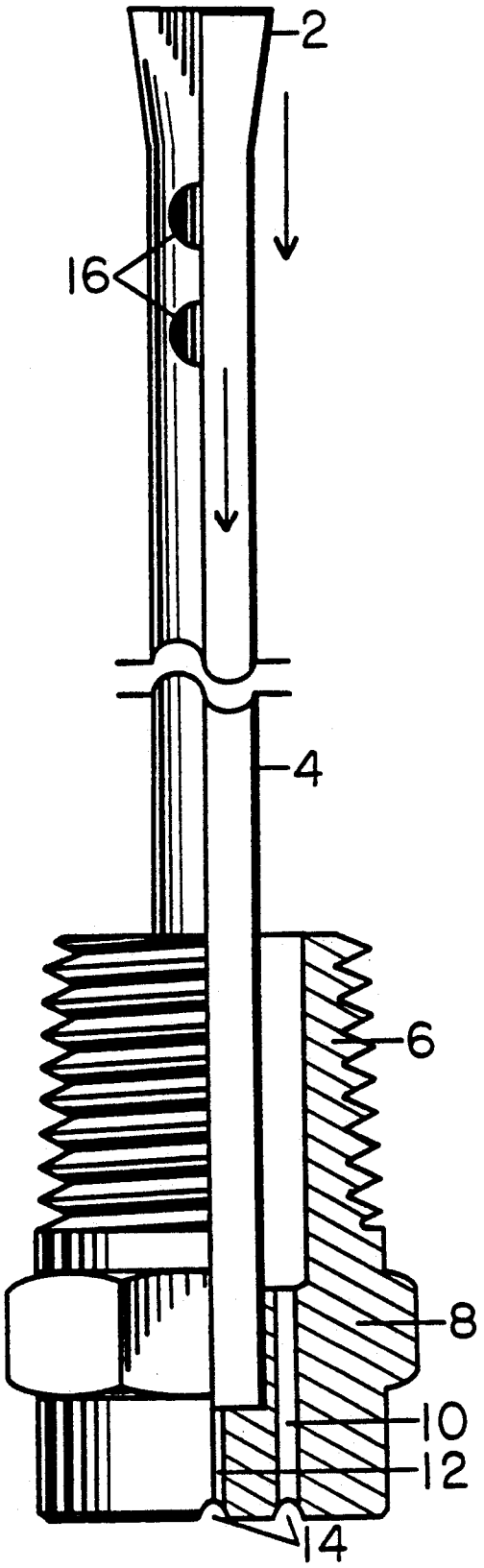
FIG. 2 is a ¾ sectional view with a combined perspective and detailed view of the device in accordance with the invention.

FIG. 1 shows the major components of the system according to the preferred embodiment. The system includes a source of liquid (1) connected via a control means (7) to a fluid conveying means (5), and a source of compressed gas (3) connected via a control means (9) to fluid conveying means (5). Fluid conveying means (5) is connected to nozzle body (8) by means of screw-threads (6) as shown in FIG. 2.

As shown in the drawing, the preferred embodiment of the Alternating Liquid/Gas Antifreeze Nozzle takes place during below freezing conditions, and in accordance with the present invention includes: an orificed (16) tube (4) which is singularly closed upstream of its aperture (indirect) (12); so as when liquid flows downstream some of the liquid is deflected off of the closed-end tube at 2 and is diverted to flow both outside and inside of the tube (arrows). After use of the device, the liquid is expelled with pressurized gas through both the direct (10) and indirect (12) apertures. Any residual liquid remains only in the direct aperture (10). It is believed that the invention operates on the basis of: as the liquid is being expelled by use of the pressurized gas through the nozzle apertures (10 and 12), the resulting pressure differentials developed between the areas (arrows) upstream of both apertures allow the indirect aperture (12) to evacuate prior to the direct aperture (10). The invention allows for complete evacuation of liquids from at least one aperture thus allowing the use of a spraying system in freezing temperatures. The use of a pressurized gas is essential. The preferred method for creating the invention includes, but is not limited to, use of a permanently mounted, orificed (16) tube (4) (cylindrical preferred, but not essential; neither limited to length, hole size, or configuration); said tube (4) being singularly closed by tapered crimping (2) or by other means, and having a separate aperture (12). The tube is made part of the nozzle body (8) by any method, so as to allow a separate aperture (10); a threaded mounting is shown (6), but should not be limited to such. Direction of flow of both the liquid and gas is indicated per arrows on the drawing. Item 14 is shown to identify the liquid pattern-modifying groove, which is preferred, but not essential. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A system for preventing the total freeze-up of the outlet apertures of a nozzle device, the system comprising:

a) a nozzle body having a downstream end and an upstream end; the downstream end having a centrally located passageway terminating in a first aperture and a second passageway terminating in a second aperture, said second passageway being radially offset from and parallel to said first passageway; the upstream end of the nozzle body including screw-threads for attachment to a fluid conveying means;

b) a cylindrical tube having an upstream end and a downstream end, the upstream end being closed by a crimp, the downstream end being connected to said first passageway; the cylindrical tube further includes at least one opening located intermediate said downstream and upstream ends, the opening permitting a fluid to flow into said cylindrical tube;

c) a fluid conveying means connected to said nozzle body by said screw-threads;

d) liquid supply means connected to said fluid conveying means via a first control means; and e) compressed gas supply means connected to said fluid conveying means via a second control means;

wherein when liquid is being sprayed, liquid flows from said liquid supply means through said fluid conveying means to said second aperture via said second passageway and to said first aperture via said at least one opening into said cylindrical tube and through said first passageway, and wherein after the spraying of liquid through the nozzle device, compressed gas is supplied from said gas supply means through said fluid conveying means to said second aperture via said second passageway and to said first aperture via said at least one opening into said cylindrical tube and through said first passageway, the compressed gas expelling any liquid remaining in said cylindrical tube through said first passageway and first aperture and any liquid remaining in said fluid conveying means through said second passageway and second aperture, thereby maximizing the evacuation of liquid from said system and minimizing the chances that both apertures will clog at the same time due to ice formation.

* * * * *